United States Patent [19]

Abe et al.

[11] 4,391,237

[45] Jul. 5, 1983

[54] APPARATUS FOR USE IN STARTING A DIESEL ENGINE

[75] Inventors: Yoshiaki Abe, Higashimatsuyama; Yutaka Kubota, Kawagoe; Hitoshi Sugimoto, Higashimatsuyama, all of Japan

[73] Assignee: Diesel Kiki Co., Ltd., Japan

[21] Appl. No.: 242,384

[22] Filed: Mar. 10, 1981

[30] Foreign Application Priority Data

Mar. 12, 1980 [JP] Japan ..... 55/31049

[51] Int. Cl.[3] ..... F02N 17/00

[52] U.S. Cl. ..... 123/179 H; 123/145 A; 123/179 B; 219/497

[58] Field of Search ..... 123/145 A, 179 H, 179 B, 123/179 BG; 219/492, 497, 507, 508, 509, 510, 519

[56] References Cited

U.S. PATENT DOCUMENTS

| | | | |
|---|---|---|---|
| 4,024,408 | 5/1977 | Coleman et al. | 290/37 |
| 4,088,109 | 5/1978 | Woodruff et al. | 123/179 H |
| 4,137,885 | 2/1979 | Van Ostrom | 123/179 H |
| 4,196,712 | 4/1980 | Kawamura et al. | 123/179 H |
| 4,258,687 | 3/1981 | Abe | 123/179 H |
| 4,278,872 | 7/1981 | Koether et al. | 219/497 |
| 4,283,619 | 8/1981 | Abe | 123/179 H |
| 4,359,643 | 11/1982 | Tada et al. | 290/38 R |

FOREIGN PATENT DOCUMENTS

| | | | |
|---|---|---|---|
| 2726458 | 1/1979 | Fed. Rep. of Germany | 219/497 |
| 2743059 | 4/1979 | Fed. Rep. of Germany | 123/179 H |
| 2913101 | 4/1979 | Fed. Rep. of Germany . | |
| 54-138978 | 10/1979 | Japan | 219/497 |
| 55-125362 | 9/1980 | Japan | 123/145 A |
| 55-128667 | 10/1980 | Japan | 123/145 A |

*Primary Examiner*—Parshotam S. Lall

*Attorney, Agent, or Firm*—Guy W. Shoup; Gerard F. Dunne

[57] ABSTRACT

An apparatus of the present invention has a first switch for controlling the supply of a first current to each glow plug, a second switch for controlling the supply of a second current being below the first current, preheating means for turning on the first switch for a predetermined time period responsive to the switching of an ignition switch from the OFF position to the ON position, and afterglow means for turning on the second switch to heat each glow plug for a predetermined time period responsive to the switching of the ignition switch from the ST position to the ON position. In the apparatus, the first or the second switch is periodically operated by controlling means to maintain the temperature of each glow plug at a predetermined value. Therefore, it is easy to avoid unnecessary increases in glow plug temperature and to control the temperature of the glow plugs to a predetermined value, the service life of the glow plugs can be extended.

13 Claims, 5 Drawing Figures

APPARATUS FOR USE IN STARTING A DIESEL ENGINE

This invention relates to an apparatus for use in starting a diesel engine having glow plugs, and more particularly to an apparatus which improves the starting characteristics of diesel engines and is able to effectively prevent the glow plugs from being overheated.

A conventional auxiliary device for starting a cold diesel engine has a circuit including glow plugs typically charged from a capacitor whose charge level is altered in response to the temperature of the flow plugs or, perhaps, the engine temperature, and the temperature of the glow plugs can be determined from the value of the charging voltage on the capacitor. In such a device, the preheating time for the glowing plugs is controlled by the charging voltage on the capacitor, and a pilot lamp is lit during the preheating operation. Consequently, the preheating operation for the glow plugs is started just after the ignition switch is turned to its on position, and the pilot lamp is lit. When the temperature of the glow plugs reaches the required level, this fact is detected from the value of the charging voltage on the capacitor, and the current flowing through the glow plugs is cut off. At the same time, the pilot lamp is turned off.

With the conventional apparatus for use in starting a diesel engine, constructed as described above, a smooth starting operation will be obtained if the engine is started just after the preheating operation is finished. However, if the engine is started a short time thereafter, it is unlikely that smooth starting of the cold engine can be attained since the temperature of the glow plugs may have become lower than the temperature required for smooth starting.

In addition, even if the engine does start, it will not easily warm up from its cold condition and will suffer from poor fuel combustion. As a result, the engine is liable to produce much smoke. In such a condition, the engine also tends to stall once started.

For these reasons, an apparatus has previously been proposed, which comprises a circuit for energizing the glow plugs for a predetermined time period after the cranking period on the engine. However, this proposed apparatus gives no consideration to maintaining the temperature of the glow plugs easily and effectively with less power consumption.

It is an object of the present invention to provide an improved apparatus for use in starting a diesel engine which facilitates the smooth starting of a cold engine.

It is another object of the present invention to provide an apparatus for use in starting a diesel engine which has improved glow plug temperature control characteristics.

It is a further object of the present invention to provide an apparatus for use in starting a diesel engine which is capable of economically maintaining the temperature of the glow plugs at a predetermined temperature after the termination of a quick preheating operation.

According to the present invention, there is provided an apparatus for use in starting a diesel engine having glow plugs, the apparatus comprising a first switch connected between the glow plugs and a power source, and a series circuit constituted of a second switch and a resistor. The first switch being connected in parallel with the series circuit. The apparatus also comprises a quick preheating circuit for turning on the first switch and maintaining it in the ON state for a predetermined time period in response to the switching operation of an ignition switch from the OFF position to the ON position, an afterglow circuit for closing the second switch for a predetermined time period in response to the operation of returning the ignition switch from the ST position to the ON position and means for periodically ON/OFF operating the first or the second switch. The first switch is periodically ON/OFF operated in accordance with the signal from an oscillator of a control means when the ignition switch is switched to the ST position or the second switch is periodically ON/OFF operated in a similar way for a predetermined time period after the ignition switch is switched from the ST position to the ON position, whereby the temperature of the glow plugs is maintained at a predetermined value.

Moreover, the current supplied through the first switch is of a first level sufficient for heating the glow plugs relatively quickly and the current supplied through the second switch is of a second level, below the first level, for maintaining the temperature of the glow plugs during starting of the diesel engine. The operation of the afterglow circuit may be cut off in accordance with the operation of a coolant temperature detecting switch, a gear switch or a charge switch for detecting the starting of the engine.

Further objects and advantages of the invention will be clear from the following detailed description to be read in conjunction with the accompanying drawings in which.

Figure 1A:
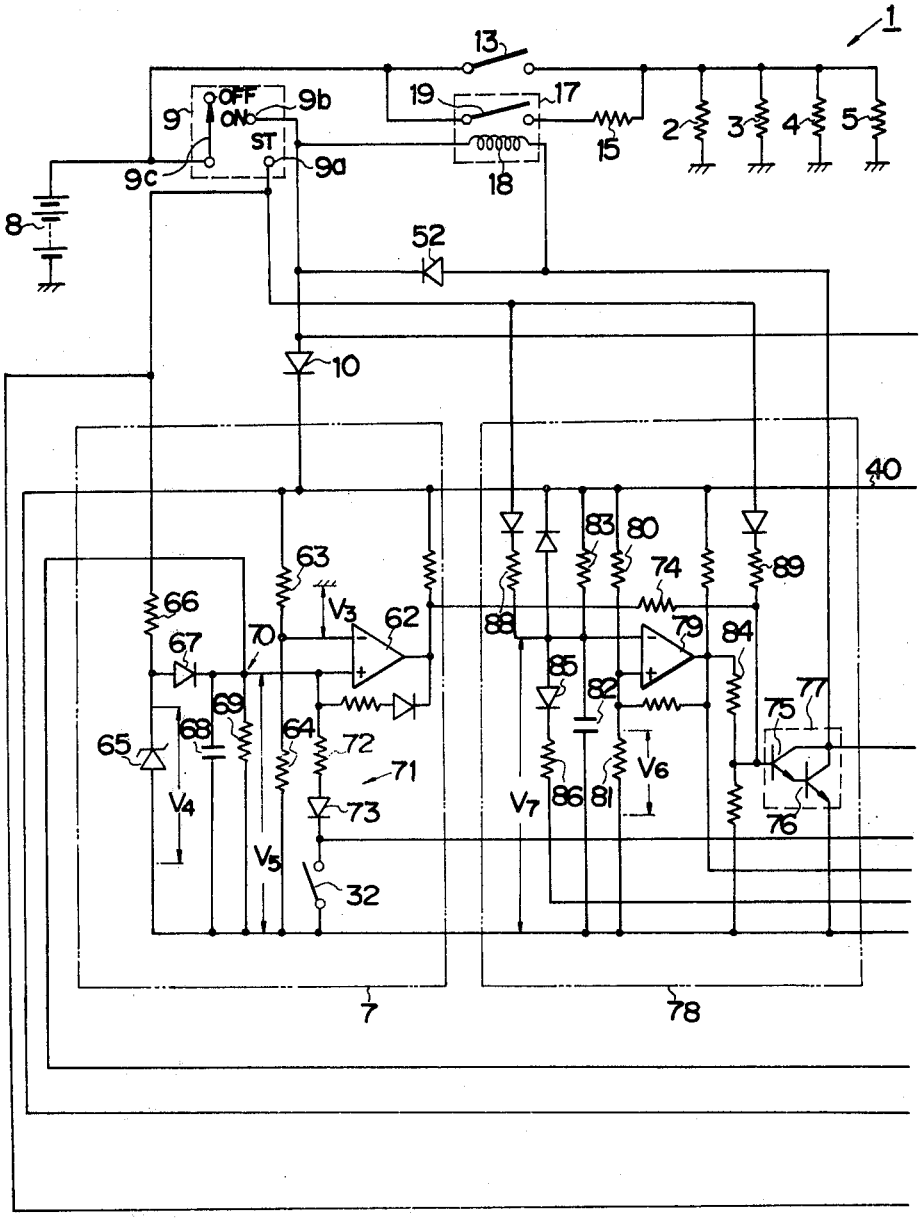
FIGS. 1A and 1B are a schematic diagram of an illustrative embodiment of the present invention.
Figure 1B:
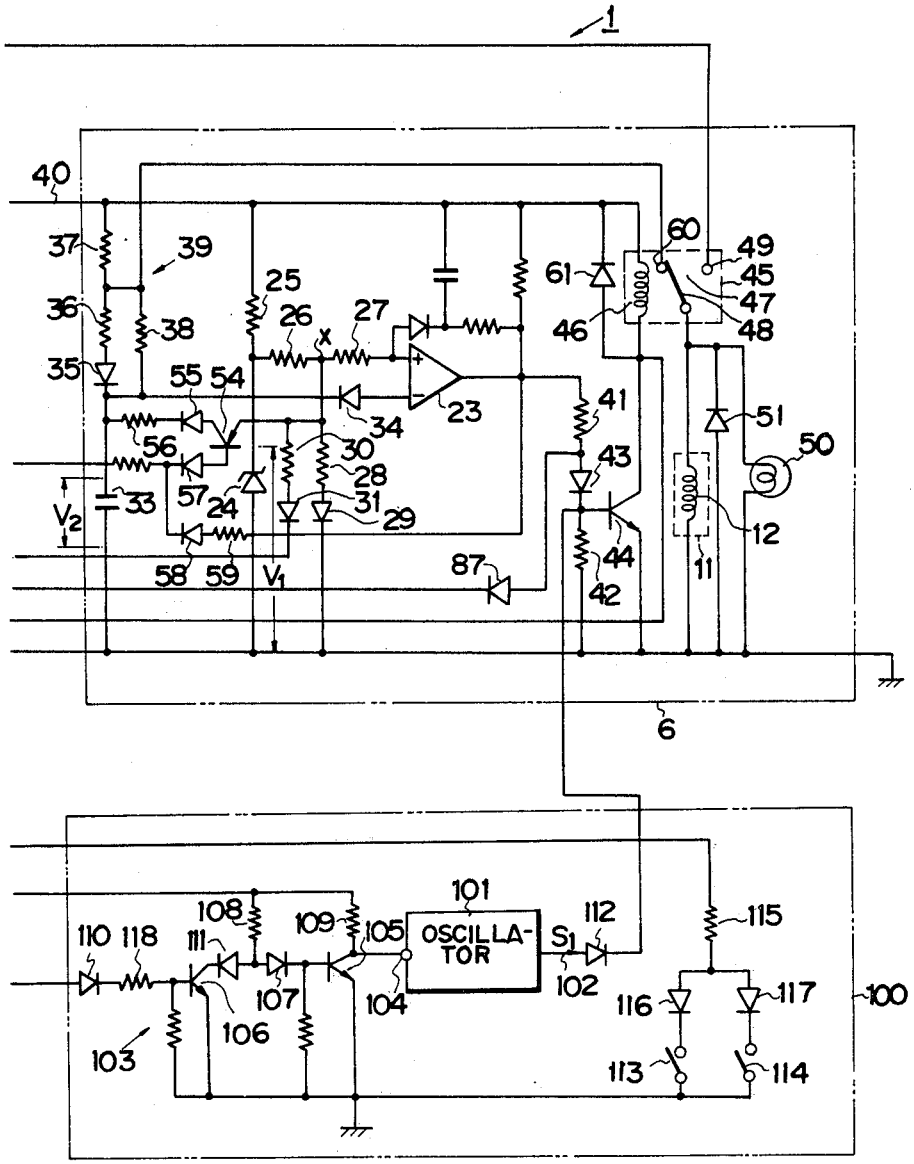

Referring to FIG. 1, there is shown an apparatus 1 for use in starting diesel engines, which controls the preheating condition of glow plugs 2 to 5 provided for the respective cylinders of a four cylinder diesel engine (not shown). It is well understood, however, that the present invention may be applied to a diesel engine having any number of cylinders. The apparatus 1 comprises a quick preheating circuit 6 for rapidly preheating the glow plugs 2 to 5 up to a predetermined temperature and an afterglow circuit 7 for heating the glow plugs for a predetermined time after the engine is started. To these circuits 6 and 7 is applied a voltage from a battery 8 through an ignition switch 9 having three switch positions: OFF, ON and START (ST), and having stationary contacts 9*a*, 9*b* and a movable contact 9*c*. The battery power is not supplied to the circuit side when the ignition switch 9 is in OFF position. However, when the ignition switch 9 is switched to the ON position by the operator, the movable contact 9*c* comes in contact with the stationary contact 9*b* to supply power from the battery 8 to the circuit side through a diode 10. When the ignition switch 9 is further switched from the ON position to the ST position, the movable contact 9*c* comes in contact with both stationary contacts 9*a* and 9*b* at the same time, and a starting motor (not shown) is energized.

The four glow plugs 2 to 5 are connected in parallel with each other and are connected with the battery 8 through a normally open switch 13 which is closed by the energization of the coil 12 of a relay 11 in the quick preheating circuit 6. The switch 13 is connected in parallel with a series circuit comprised of a temperature control resistor 15 and a normally open switch 19 which is closed by the energization of the coil 18 of a relay 17, as will be described more fully below. Diodes 51 and 52 are connected in parallel with the coils 12 and 18, respectively, and they suppress the induction voltage generated in the coils.

The quick preheating circuit 6 includes an operational amplifier 23, and to the non-inverting input terminal thereof is applied a bias voltage $V_1$ produced by a zener diode 24 and a resistor 25 through resistors 26 and 27. The connecting point X between the resistors 26 and 27 is grounded through a resistor 28 and a diode 29. The point X is also grounded through a resistor 30, a diode 31 and a coolant temperature detecting switch 32. The switch 32 is a normally open switch and is closed when the coolant temperature of the engine reaches and exceeds a predetermined level 6, such as 0° C. Thus, the potential of the connecting point X is controlled by the coolant temperature.

On the other hand, to the inverting input terminal of the operational amplifier 23 is applied a charge voltage $V_2$ developed across a capacitor 33 through a diode 34. One end of the capacitor 38 is connected with a positive line 40 through a passive network 39 consisting of a diode 35, and resistors 36, 37 and 38. The positive line 40 is connected to the contact **9*b* of the ignition switch 9 through the diode 10. Therefore, when the ignition switch 9 is switched from its OFF position to its ON position, the charge voltage $V_2$ rises according to a time constant $t_1$ which is determined by the combined resistance value of the passive network 39 and the capacitance value of the capacitor 33. As a result, the output level of the operational amplifier 23 is high until the inverting input terminal voltage thereof becomes larger than that of the non-inverting input terminal. During the period of high output from operational amplifier 23, a transistor 44 biased by resistors 41, 42, and a diode 43 stays ON. The coil 46 of a relay 45 is therefore energized and the movable contact 48 of the changeover switch 47 in the relay 45 comes into contact with a fixed contact 49 to energize the coil 12. With this energization, the switch 13 is closed and the glow plugs 2 to 5 are directly heated by the application of current from the battery 8. At the same time, a lamp 50 connected in parallel with the coil 12 is lit to indicate that the device 1 is in the state of quick preheating operation. The collector of a transistor 54 is connected with a diode 55 and a resistor 56, while the emitter of the transistor 54 is connected with the point X. The base of the transistor 54 is connected with the output terminal of the operational amplifier 23 through diodes 57, 58 and a resistor 59, and the charge voltage of the capacitor 33 can therefore be controlled also by the output level of the operational amplifier 23. After the predetermined time $t_1$ has passed after the ignition switch 9 is turned to its ON position, the inverting input terminal voltage of the operational amplifier 23 becomes larger than that of its non-inverting input terminal due to the increase in the charge voltage $V_2$. As a result, the output level of the operational amplifier becomes low. The transistor 44 thus goes off and the movable contact 48 moves into contact with a fixed contact 60. The relay 11 is thus deenergized and the lamp 50 is turned off. On the other hand, a diode 61 connected in parallel with the coil 46 absorbs the induced voltage generated across the coil 46**.

Now an explanation will be given on the afterglow circuit 7. The circuit 7 comprises an operational amplifier 62 having an inverting input terminal to which a bias votage $V_3$ divided by resistors 63, 64 is applied. The contact **9*a* of the ignition switch 9 is connected through a resistor 66 with the cathode of a zener diode 65, whose anode is grounded. A constant voltage $V_4$ produced across the zener diode 65 is applied to a charge and discharge circuit 70 through a diode 67. The circuit 70 comprises a capacitor 68 and a resistor 69 connected in parallel and is connected between the non-inverting input terminal of the operational amplifier 62 and ground. The voltage $V_5$ developed across the circuit 70 is applied to the non-inverting input terminal of the operational amplifier 62. The discharge time constant of the circuit 70 depends on the value of the resistor 69. An additional circuit 71 is connected in parallel with the resistor 69 in order to change the discharge time in accordance with the coolant temperature of the engine. The additional circuit 71 comprises a series circuit, including the coolant temperature detecting switch 32, a resistor 72 and a diode 73. By the closure of the switch 32 when the coolant reaches a predetermined temperature, the effective resistance of the circuit 71 is placed in parallel with resistor 69 and the discharge time of the capacitor 68 becomes smaller. The output of the operational amplifier 62 is input as a control signal into a switch 77 comprised of two transistors 75 and 76, through a resistor 74. The transistors 75 and 76 are arranged in Darlington connection. The switch 77 is used for controlling the relay 17 and when the potential at the base of the transistor 75 becomes high, the coil 18 is energized. Therefore, when the ignition switch 9 is in ON position, the voltage $V_3$ is applied to the inverting input terminal of the operational amplifier 62 and the output of the operational amplifier 62 is low since the non-inverting input terminal thereof is grounded through the resistor 69. Turning the ignition switch 9 from its ON position to the ST position, however, charges the capacitor 68 through the resistor 66 until it reaches the voltage determined by the zener diode 65, whereby the output level of the operational amplifier 62 becomes high. As a result, the switch 19 is closed and preheating current flows into the glow plugs 2 to 5 through the resistor 15. Due to the increased load of the resistor 15, the preheating current to the glow plugs 2 to 5 is at this time less than the initial current at the time of closing of the relay 13 of the quick preheating circuit 6**.

When the ignition switch 9 is returned from the ST position to the ON position after the engine starts, the charge and discharge circuit 70 then assumes its discharge mode and the value of the voltage $V_5$ falls in accordance with the time constant of the charge and discharge circuit 70. After the predetermined time has passed, the voltage applied to the non-inverting input terminal of the operational amplifier 62 becomes lower than the voltage $V_3$ becaused of the discharge of the capacitor 68, and the output level of the operational amplifier 62 becomes low and the coil 18 is deenergized to terminate the preheating operation of the glow plugs 2 to 5. As will be seen from the above explanation, the afterglow time, that is the period from the return of the ignition switch 9 from its ST position to its ON position until the end of the preheating by the afterglow circuit 7, depends upon the discharge time of the capacitor 68. Therefore, when the coolant temperature is higher than the predetermined value, the afterglow time is short, and when the temperature is below such value, it becomes longer.

The apparatus for use in starting the diesel engine of this invention is further provided with a preheating maintenance circuit 78 for maintaining the predetermined temperature of the glow plugs for a predetermined time even after the termination of the quick preheating operation by the quick preheating circuit 6. The preheating maintenance circuit 78 has an operational amplifier 79 having a non-inverting input terminal receiving a predetermined constant voltage $V_6$ produced by a voltage dividing circuit consisting of resistors 80 and 81. A capacitor 82 is connected between ground and the inverting input terminal of the operational amplifier 79, and the current for charging the capacitor 82 flows through a resistor 83 when the ignition switch 9 is switched to the ON position. The charging voltage $V_7$ produced across the capacitor 82 is applied to the inverting input terminal of the operational amplifier 79 to thereby control the amplifier 79. The output of the operational amplifier 79 is high when the voltage $V_6$ is higher than $V_7$ and is applied to the base of the transistor 75 through a resistor 84. Consequently, the output level of the operational amplifier 79 is high just after the ignition switch 9 is changed to the ON position, and becomes low after the lapse of a predetermined time. However, since the power source and the glow plugs 2 to 5 are directly connected by the operation of the quick preheating circuit 6, the quick preheating continues irrespective of the operation of the preheating maintenance circuit 78.

While the quick preheating circuit 6 is in operation, the charging voltage of the capacitor 82 is suppressed, and for this purpose, there is connected between the inverting input terminal of the operational amplifier 79 and the collector of the transistor 44 a series circuit consisting of a diode 85 and a resistor 86 as illustrated in FIG. 1. Therefore, when the transistor 44 is in its ON state the glow plugs 2 to 5 start to be quickly preheated and the inverting input terminal of the operational amplifier 79 is then grounded through the diode 85 and the resistor 86. Thus, the voltage $V_7$ is suppressed to a lower value than $V_6$. As a result, the output of the operational amplifier 79 is maintained at a high level at least during the quick preheating operation. In case that the quick preheating is stopped for some reason, the voltage $V_7$ begins to rise and comes to exceed $V_6$ after the lapse of a predetermined time period. In this time period after the termination of the quick preheating operation, the current for maintaining the temperature passes to the glow plugs 2 to 5 through the switch 19 and the load varying temperature control resistor 15. It may be said therefore that the termination of the quick preheating can be ignored. The output terminal of the operational amplifier 79 is connected with the connecting point between the resistor 41 and the diode 43 through a diode 87 and thus the transistor 44 is turned off when the output level of the operational amplifier 79 becomes low.

Changing over the ignition switch 9 from the ON position to the ST position causes the capacitor 82 to be charged evenly through a resistor 88, and the output of the operational amplifier 79 quickly drops and stops the operation of the preheating maintenance circuit 78. As long as the ignition switch 9 is in the ST position, however, the current flowing through a resistor 89 keeps the switch 77 ON and continues the preheating for maintaining the temperature of the glow plugs.

According to the circuit construction described above, switching the ignition switch 9 from OFF position to ON position causes the switch 13 of the quick preheating circuit 6 to close so as to rapidly heat the glow plugs 2 to 5 with a relatively large current. At this time, the switch 19 is closed by the operation of the preheating maintenance circuit 78, but the glow plugs 2 to 5 are heated directly by the battery 8 through the switch 13. The afterglow circuit 7 is inoperative at this time. After a predetermined time has passed, the relays 45 and 11 are deenergized due to the rise of the charging voltage on capacitor 33 and the quick preheating operation terminates. On the other hand, the charging operation of the capacitor 82 is started since the transistor 44 is now OFF. The capacitor 82 is charged through the resistor 83. The temperature of the glow plugs 2 to 5 is maintained by a reduced current flow until the voltage $V_7$ becomes larger than $V_6$. In other words, the temperature of the glow plugs can be maintained for a predetermined time even if the ignition switch 9 is still in its ON position after the quick preheating.

In this case, the capacitor 33 is discharged through the coil 12 when the coil 12 is connected to the contact 60 via the movable contact 48, and the output level of the operational amplifier 23 is again made high. The time when the output level of the operational amplifier 23 becomes high is set after the termination of the heat maintenance operation by the preheating maintenance circuit 78. For this reason, the transistor 44 is turned off before the output level of the operational amplifier 23 becomes high. Therefore, even if the preheating maintenance operation terminates while the ignition switch 9 is at the ON position, quick preheating does not commence.

After the termination of the quick preheating, the operator normally turns the ignition switch 9 from ON position to ST position. The charge current now flows into the capacitor 82 also through the resistor 88 to rapidly charge the capacitor 82. As a result, the output to the operational amplifier 79 in the preheating maintenance circuit 78 becomes low within a very limited time. On the other hand, when the ignition switch 9 is turned to the ST position, charging of the capacitor 68 begins and when the voltage $V_5$ becomes larger than the voltage $V_3$, the switch 77 turns on. As a result, the switch 17 turns on irrespective of the output level of the operational amplifier 79, thereby heating the glow plugs 2 to 5. At the same time, the coil 12 is energized and the glow plugs are heated by a larger heating current than that for maintaining temperature. This is the afterglow operation.

Returning the ignition switch 9 from the ST position to the ON position causes the capacitor 68 to discharge and after a predetermined time the output level of the operational amplifier 62 becomes low. The relay 17 is thereby deenergized and the heating operation of the glow plugs according to this device is stopped.

For further improving the temperature maintenance characteristics of the glow plugs in the apparatus 1 of the present invention, a temperature controlling circuit 100 which specially controls the temperature of the glow plugs so as to maintain them at a predetermined temperature while the ignition switch 9 is in the ST position is provided. The temperature controlling circuit 100 has an oscillator 101 for producing a square wave signal $S_1$ on the output line 102, and an interface circuit 103 which renders the oscillator 101 operative (or inoperative) by applying a high voltage (or low voltage) to the control terminal 104 of the oscillator in accordance with the position of the ignition switch 9. In this embodiment, the oscillator 101 is arranged so as to be operative when a high voltage is applied to the control terminal 104 and be inoperative when a low voltage is applied thereto. Such an oscillator can be easily realized by, for example, combining a conventional square wave oscillator with an AND circuit.

Figure 2:
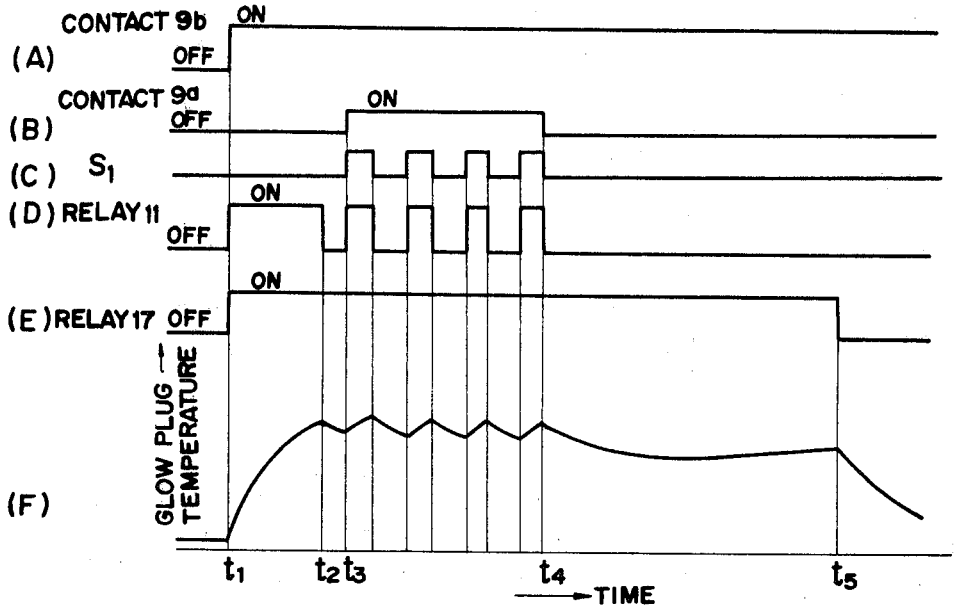
FIGS. 2A to 2F are timing charts for explaining the operation of the device illustrated in FIG. 1.

The interface circuit 103 includes transistors 105 and 106. The emitter of the transistor 105 is grounded and its oscillator is connected to the control terminal 104. The base of the transistor 105 is connected to the positive line 40 through a diode 107 and a resistor 108 and the collector thereof is also connected to the positive line 40 through a resistor 109. The emitter of the transistor 106 is grounded and its base is connected to the stationary contact 9*a* of the ignition switch 9 through a resistor 118 and a diode 110. The collector thereof is connected to the anode of the diode 107 through a diode 111. The output of the oscillator 101 is connected to the base of the transistor 44 through a diode 112. Consequently, when the ignition switch 9 is switched to its ON position, since the transistor 106 is in the OFF state to make the base voltage of the transistor 105 high, the transistor 105 is in ON state so that the voltage at the control terminal 104 of the oscillator 101 is low. As a result, the signal $S_1$ is not produced and the diode 112 is biased in the reverse direction. When the ignition switch 9 is switched from its ON position to the ST position, since the transistor 106 is turned ON to turn off the transistor 105, the voltage at the control terminal 104 becomes high so that the signal $S_1$ is produced. Therefore, the square wave signal $S_1$ as illustrated in FIG. 2C is applied to the base of the transistor 44, and ON/OFF operation of the relay 11 will be carried out in accordance with the period of the signal $S_1$ as will be hereinafter described in more detail. The temperature controlling circuit 100 is produced with a charge switch 113 which is closed in response to the starting of the engine and a gear switch 114 which is closed in response to an operation for bringing the gears of the vehicle's transmission system into operative condition. One terminal of each of the switches 113 and 114 is grounded and the other terminal of each is connected to the non-inverting input terminal of the operational amplifier 62 in the afterglow circuit 7 through a resistor 115 and a diode 116 or a diode 117. Therefore, when at least one of the switches 113 and 114 is closed, the output level of the operational amplifier 62 is low since the level of the non-inverting input terminal thereof is made lower than that of the inverting input terminal, and the relay 17 is deenergized so that the preheating operation for the glow plugs by the afterglow circuit 7 and/or the temperature controlling circuit 100 is stopped.

The preheating maintenance operation carried out by the temperature controlling circuit 100 will be described in more detail with reference to FIGS. 2A to 2F. When the ignition switch 9 is switched from its OFF position to the ON position at the time $t_1$, the movable contact 9*c* of the ignition switch 9 comes in contact with the stationary contact 9*b* and the relays 11 and 17 are energized by the quick preheating circuit 6 and the preheating maintenance circuit 78, respectively (FIGS. 2A, 2D and 2E). As a result, a relatively large current flows into the glow plugs 2 to 5 through the switch 13 to preheat the glow plugs, and the temperature of the glow plugs is rapidly increased. At the time $t_2$ when $V_2$ becomes larger than $V_1$, only the relay 11 is deenergized so that the heating of the glow plugs 2 to 5 is continued by the relatively small current provided through the relay 17. At this time, the temperature of the glow plugs begins to decrease slightly due to the smaller heating current (FIG. 2F). When the ignition switch 9 is then switched over from its ON position to the ST position at time $t_3$, the contact 9*c* also comes in contact with contact 9*a* and the oscillator 101 starts to produce the square wave signal $S_1$ (FIG. 2C). Therefore, as described above, the relay 11 is intermittently driven in accordance with the signal $S_1$ as long as the ignition switch 9 is in the ST position. Consequently, during the period from $t_3$ to $t_4$, the glow plugs are heated by a relatively large current when the relay 11 is in ON state, whereas the glow plugs are heated by a relatively small current when the relay 11 is in OFF state. As a result, since the lowering of the temperature of the glow plugs due to the OFF state of the relay 11 can be compensated for by intermittent heating using the relatively large current from the relay 11 when it is in ON state, the temperature of the glow plugs can be controlled substantially to a predetermined value if the frequency and/or the duty ratio of the square wave signal $S_1$ is properly adjusted.

When the ignition switch 9 is switched from its ST position to the ON position at the time $t_4$, the oscillator 101 ceases to produce the signal $S_1$ and the glow plugs are heated by a smaller current again. When the operation of the afterglow circuit 7 is terminated at the time of $t_5$, the relay 17 is also deenergized to completely stop the operation of the apparatus 1.

Figure 3:
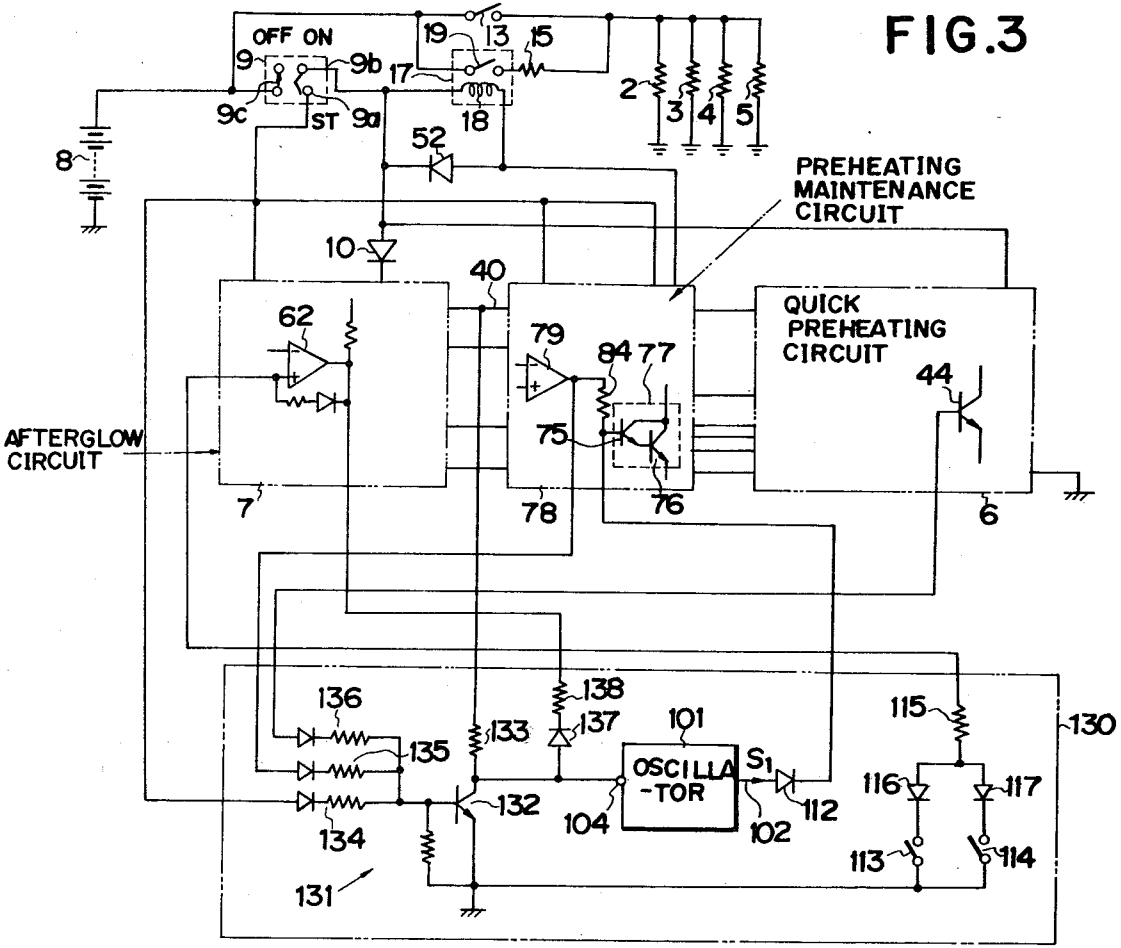
FIG. 3 is a schematic diagram of another embodiment of the present invention.

In FIG. 3, there is illustrated another embodiment of the present invention which is different from the embodiment shown in FIG. 1 only in the arrangement of one portion of a temperature controlling circuit 130. Therefore, the portions or elements of FIG. 3 corresponding to the portions or elements shown in FIG. 1 are designated by like reference symbols and the details of the circuits 6, 7 and 78 are omitted from FIG. 3 as the arrangement of these is the same as that of FIG. 1.

The apparatus for use in starting a diesel engine shown in FIG. 3 has a temperature controlling circuit 130 which is arranged so as to carry out the temperature controlling operation during the operation of the afterglow circuit 7. The temperature controlling circuit 130 has a control logic circuit 131 for enabling the oscillator 101 to produce the square wave signal $S_1$ when the afterglow circuit 7 is in operation. The control logic circuit 131 has a transistor 132 the collector of which is connected to the control terminal 104 and to the positive line 40 through a resistor 133. The emitter of the transistor 132 is grounded and the base thereof is connected to the contact 9*a*, the output terminal of the operational amplifier 79 and the base of the transistor 44 through series circuit 134, 135 and 136, respectively. Each of these series circuits 134, 135 and 136 is composed of a diode and a resistor connected in series therewith. Therefore, when the potential at any one among the contact 9*a*, the output terminal of the operational amplifier 79 and the base of the transistor 44 is low, the transistor 132 is turned OFF.

The control terminal 104 is also connected to the output terminal of the operational amplifier 62 through a diode 137 and a resistor 138 so that the potential at the control terminal 104 becomes low irrespective of the condition of the transistor 132 when the output level of the operational amplifier 62 becomes low.

Figure 4:
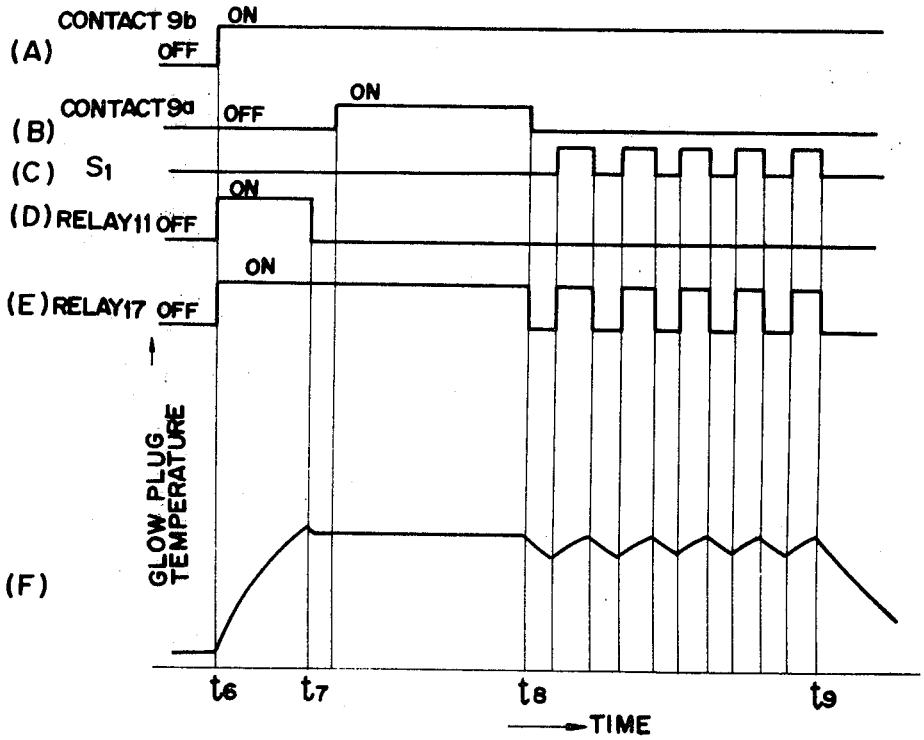
FIGS. 4A to 4F are timing charts for explaining the operation of the device illustrated in FIG. 3.

The operation of the apparatus of FIG. 3 will now be described with reference to FIGS. 4A to 4F. When the ignition switch 9 is switched from its OFF position to the ON position at $t_6$, the relays 11 and 17 are energized and the glow plugs are quickly heated by the relatively large current in a similar way as described in connection with FIG. 1 (FIGS. 4A, 4C and 4E). The oscillator 101 is inoperative since the base voltage of the transistor 44 is so high that the transistor 132 is turned ON from $t_6$ to $t_7$. The relay 11 is deenergized by the quick preheating circuit 6 at $t_7$ and the glow plugs are heated by a relatively small current due to the operation of the preheating maintenance circuit 78 after the time of $t_7$. Consequently, as shown in FIG. 4F, the temperature of the glow plugs decreases slightly, but the rate of temperature decrease is not so large until the ignition switch 9 is switched from its ST position to the ON position at $t_8$. Furthermore, since the output level of the operational amplifier 62 is low after $t_7$, the oscillator 101 is also inoperative so that the signal $S_1$ is not produced (FIG. 4C). When the afterglow circuit 7 comes into operative condition after $t_8$, the output level of the operational amplifier 62 becomes high and the base voltage of the transistor 132 is high enough to turn the transistor 132 ON. Therefore, the oscillator 101 is made operative and the square wave signal $S_1$ is applied to the base of the transistor 75. As a result, during the afterglow operation period from $t_8$ to $t_9$, the relay 17 is intermittently energized in accordance with the change in level of the signal $S_1$, and a relatively small intermittent current flows into the glow plugs 2 to 5 through the switch 19 and the resistor 15. Thus, the temperature of the glow plugs 2 to 5 can be kept at a desired predetermined temperature by properly adjusting the duty ratio and/or the frequency of the signal $S_1$ in a similar way to that in the embodiment of FIG. 1. Therefore, the oscillator 101 is preferably a variable frequency oscillator easily adjustable from outside.

Since with this embodiment of the present invention it is easy to avoid unnecessary increases in glow plug temperature and to control the temperature of the glow plugs to a predetermined value, the service life of the glow plugs can be extended.

We claim:

1. An apparatus for use in starting a diesel engine having at least one glow plug energized by actuation of an ignition switch having an OFF position, an ON position for connecting said apparatus to a voltage source and an ST position for starting the diesel engine, said apparatus comprising:

means including a first switch for connecting each said glow plug to the voltage source to supply a first level of current to each said glow plug;

means including a second switch for connecting each said glow plug to the voltage source through a resistance adapted to limit the current from the voltage source to supply a second level of current below said first level to each said glow plug;

preheating means for activating said first switch for a first predetermined time period beginning from switching of said ignition switch from the OFF position to the ON position;

afterglow means for activating said second switch for a second predetermined time period beginning from the switching of said ignition switch from the ST position to the ON position; and controlling means for periodically activating and de-activating said first switch to periodically supply said first level of current and maintain the temperature of each glow plug within a predetermined range during a period of time occurring when said ignition switch is in the ST position.

2. An apparatus as claimed in claim 1 wherein said controlling means includes an oscillator adapted to produce an oscillating output signal during said period of time, amd means receiving said output signal for controlling said first switch according to the period of said oscillator.

3. An apparatus as claimed in claim 1 or 2 wherein said afterglow means includes means responsive to the temperature of the diesel engine for shortening said second predetermined time period when the temperature of the diesel engine is above a predetermined value.

4. An apparatus as claimed in claim 1, further comprising means for stopping the operation of said afterglow means in response to the starting of the diesel engine.

5. An apparatus as claimed in claim 1, further comprising means for stopping the operation of said afterglow means in response to an increase in the temperature of the coolant of the diesel engine up to a predetermined level.

6. An apparatus as claimed in claim 1, further comprising means for stopping the operation of said afterglow means in response to a gear shifting operation of the transmission system of the vehicle in which the diesel engine is installed.

7. An apparatus for use in starting a diesel engine having at least one glow plug energized by actuation of an ignition switch having an OFF position, an ON position for connecting said apparatus to a voltage source and an ST position for starting the diesel engine, said apparatus comprising:

means including a first switch for connecting each said glow plug, to the voltage source to supply a first level of current to each said glow plug;

means including a second switch for connecting each said glow plug to the voltage source through a resistance adapted to limit the current from the voltage source to supply a second level of current below said first level to each said glow plug;

preheating means for activating said first switch for a first predetermined time period beginning from the switching of said ignition switch from the OFF position to the ON position;

controlling means for periodically activating and de-activating said second switch to periodically supply said second level of current and maintain the temperature of each glow plug within a predetermined range for a period of time occurring after said ignition switch is switched from the ST position to the ON position.

8. An apparatus as claimed in claim 7 wherein said controlling means includes a timing circuit for determining said period of time, a logic control circuit for detecting that said ignition switch has been switched from the ST position to the ON position, an oscillator adapted to produce an oscillating output signal in response to the output signal from said logic control circuit, and means receiving said output signal for controlling said second switch according to the period of said oscillator.

9. An apparatus as claimed in claim 8 wherein said oscillator is a variable frequency oscillator.

10. An apparatus as claimed in claim 7 further comprising a preheating maintenance means for activating said second switch to maintain the temperature of each said glow plug at a predetermined level for a predetermined time period after the termination of the operation of said preheating means.

11. An apparatus according to claim 10, wherein said preheating maintenance means has a voltage comparator receiving a reference voltage at one input and having a timing capacitor connected to the other input thereof and means responsive to the ON position of said ignition switch for supplying current to said capacitor, and said second switch is activated in response to the output when the voltage level of said capacitor is below that of said reference voltage.

12. An apparatus according to claim 11, wherein said preheating maintenance means further includes means for holding the voltage level of said capacitor below that of said reference voltage during operation of said preheating means.

13. An apparatus according to claim 11 or 12, wherein said preheating maintenance means further includes means for inhibiting operation of said preheating means upon termination of operation of said preheating maintenance means.

* * * * *